US008312648B2

(12) United States Patent
Ballantyne

(10) Patent No.: US 8,312,648 B2
(45) Date of Patent: Nov. 20, 2012

(54) GOLF ORTHOTIC AND METHOD OF USE

(76) Inventor: John K. Ballantyne, Washington, UT (US)

( * ) Notice: Subject to any disclaimer, the term of this patent is extended or adjusted under 35 U.S.C. 154(b) by 443 days.

(21) Appl. No.: 12/772,688

(22) Filed: May 3, 2010

(65) Prior Publication Data

US 2011/0265346 A1 Nov. 3, 2011

(51) Int. Cl.
*A43B 13/38* (2006.01)
*A61F 5/14* (2006.01)

(52) U.S. Cl. ..... 36/127; 36/43; 36/142

(58) Field of Classification Search ..... 36/43, 44, 36/127, 142–144
See application file for complete search history.

(56) References Cited

U.S. PATENT DOCUMENTS

| | | | | |
|---|---|---|---|---|
| 4,232,457 | A * | 11/1980 | Mosher | 36/44 |
| 4,628,936 | A * | 12/1986 | Langer et al. | 36/173 |
| 4,813,159 | A * | 3/1989 | Weiss | 36/43 |
| 5,373,650 | A * | 12/1994 | Dananberg et al. | 36/92 |
| 6,125,557 | A * | 10/2000 | Brown | 36/144 |
| 6,269,554 | B1 * | 8/2001 | Silvestrini et al. | 36/144 |
| 6,269,555 | B1 * | 8/2001 | Brown | 36/144 |
| 6,782,643 | B2 * | 8/2004 | Brown | 36/144 |
| 7,124,518 | B1 * | 10/2006 | Brown | 36/25 R |
| 2001/0027616 | A1 * | 10/2001 | Silvestrini et al. | 36/144 |
| 2003/0226288 | A1 * | 12/2003 | Brown | 36/144 |

* cited by examiner

*Primary Examiner* — Marie Patterson
(74) *Attorney, Agent, or Firm* — J. Todd Rushton

(57) ABSTRACT

A foot orthotic for golf that provides solid stability and encourages proper foot bracing and release during the golf swing. The orthotic having a semi-rigid shell, compliant top cover, anti-skid forefoot pad and a heel post. The heel post having a short medial edge to encourage proper bracing and release and an extended lateral edge to resist foot rolling or supination during the golf swing.

18 Claims, 4 Drawing Sheets

GOLF ORTHOTIC AND METHOD OF USE

SUMMARY OF THE INVENTION

The present invention relates generally to an orthotic shoe insert and more specifically to an orthotic shoe insert for golf.

The feet are the foundation of a solid and effective golf swing. Even though the golfer is essentially stationary during the course of a golf swing, the feet are required to make intricate, athletic movements which provide fluidity, stability and power. For the vast majority of golfers, the intricate foot movements required to make a correct golf swing will not come naturally, and are difficult to visualize and fully understand. What is needed is a foot orthotic that provides solid stability and encourages proper foot bracing and release during the course of the golf swing.

In one embodiment, the golf orthotic is comprised of a semi-rigid shell, having a deep heel cup and substantial arch support, a resilient heel cushion, a top cover, an anti-skid forefoot pad and heel post.

The semi-rigid shell provides support and stabilization of the plantar surface of the foot, up to the metatarsal heads. The front portion of the semi-rigid shell provides consistent support for the metatarsal region of the foot, allowing the metatarsal bones to spread evenly and provide optimal support for the body. A substantial arch support provides pronation protection and helps to prevent or relieve the pain associated with abnormal foot conditions, such as, plantar fasciitis. The semi-rigid shell also has a deep heel cup having both medial and lateral flanges extending from rear of the calcaneus to approximately the line intersecting with the tarsal-metatarsal joint. The lateral flanges stabilize the rear foot and reduces both pronation and supination of the foot. The deep heel cup with lateral flanges also creates positive engagement between the wearer's foot and the golf orthotic. The semi-rigid shell can be made using any material which provides the correct combination of flexibility and support, such as, nylon, polyester, nylon polyester blend, polyethylene, polypropylene, plastic, or a composite such as fiberglass, Kevlar or graphite. The semi-rigid shell is the assembly foundation of the golf orthotic.

One embodiment may include a resilient heel cushion essential for wearer comfort. The heel cushion is positioned to receive the calcaneus and reduce pressure between the wearer's heel and the semi-rigid shell. The material for the heel cushion may be rubber, foam rubber, viscoelastic foam, ethylene vinyl acetate (EVA), silicone or any other suitable material.

A top cover may be included in one embodiment of the golf orthotic. The top cover may be formed using a material such as vinyl, neoprene, synthetic fabric, synthetic leather or leather. The top cover provides friction relief between the sole or plantar surface of the wearer's foot and the golf orthotic. In one embodiment, the top cover may cover the semi-rigid shell and extend to the metatarsal heads. In another embodiment, the top cover may extend to provide support of the entire foot, including the golfer's toes. The full top cover also serves as an alignment aid, or a positioning device, for the golf orthotic. When installed, the edges of the top cover engage substantially all of the shoe sidewalls, the heel box and the toe box, guiding the orthotic into proper position during installation and helping to maintain proper position during extended wear.

One embodiment includes an anti-skid forefoot pad. The forefoot pad may be composed of a material such as vinyl, rubber, neoprene, leather or another material having anti-skid properties. The bottom surface may have a texture such as dimples, bumps, ridges, grooves or treads to enhance the anti-skid properties. The forefoot pad also serves to stiffen the forefoot of the golf orthotic, improve the durability of the device and helps align the device in a shoe.

The heel foot post is an essential feature of each embodiment of the device. The heel post is adhesively attached to the semi-rigid shell and has a neutral or flat disposition or the base of the post is directly perpendicular to the vertical axis of the foot. The overall width of the post is substantially equal from the centerline to the outer edge of the lateral and medial sides. While the base of the post is flat, the post may be ground, skived, or shaped by a medical professional to accommodate anomalous foot conditions. In each embodiment, the lateral edge of the post extends substantially further forward toward the forefoot than the medial edge, or it may be stated, that the lateral edge of the post is longer than the medial edge. In the one embodiment, the leading edge, or forward edge, of the post may be a straight line extending from the medial edge to the lateral edge. In another embodiment, the leading edge may form a concave arc extending from the medial edge to the lateral edge. In other embodiments, the leading edge of the post may be an irregular line or may be formed with multiple straight lines with equal angles or may be formed with straight lines joined with varying angles. Regardless of configuration of the leading edge, in each embodiment, the lateral edge of the post extends substantially further toward the forefoot than the medial edge.

The configuration of the heel post encourages the golfer to use proper setup, firm bracing and fluid release during the course of a golf swing. Improvement during one of these stages leads to more solid ball striking ability, improved accuracy, and increased distance. Improvement at each of these fundamental stages can totally transform a golfer's swing and expected shot results. Additionally, improvement in the balance and fluidity of the swing reduces the risk of foot, knee or back injury.

Balance is essential during golf swing set up. Weight distribution should be split equally between the front foot and rear foot, or the golfer may place slightly more weight on the forward foot. Balance, heel to toe should be neutral. The rear foot should be opened or the toes of the rear foot should be pointed behind the golfer, approximately 5 to 45 degrees, with the rear foot set slightly on the medial edge or pronated. The golf orthotic, having a semi-rigid shell, a deep heel cup, arch support and a flat heel post, encourages a balanced set up. The short medial edge of the heel post encourages the golfer to set the rear foot on edge or to pronate the rear foot slightly. The short medial edge provides a tactile sensation of "gripping the ground" with the inside or medial edge of the back foot.

During the backswing or takeaway, the golfer's weight balance will shift onto the back foot, the medial edge pressure will increase, and the tactile feedback of the short medial edge will also be increased. As the backswing progresses, more of the golfer's weight is shifted onto the back foot, and at this point the golf swing can begin to breakdown. In the ideal golf swing, the backswing creates energy as a torsional moment pivoting around a straight line extending from the inside edge of the golfer's rear foot, to the point of their shoulder on the opposite side of the body. For many golfers, as the pressure builds on the rear foot, they allow the foot to roll or supinate, or they allow the hips to sway, either of these actions will release the torsional energy created by the backswing. In this situation, the big muscles in the legs, back and shoulders are effectively eliminated from the golf swing and the golfer is forced to generate most of the power using their arms and hands. Allowing the rear foot to roll or allowing the hips sway, also makes it difficult to return the club back to the ball accurately, causing poor contact with the ball, an additional loss of power and a loss of accuracy. The extended lateral edge of the heel post provides an increased line of contact with the ground, and helps eliminate the tendency for the rear foot to roll or the hips to sway. Additionally, as the golfer increases the angle that the rear foot is opened, the contact area of the lateral portion of the heel post that resists rolling is proportionately increased.

As the down swing is initiated, the golfer's weight should begin to fluidly transfer from the rear foot to the front foot. Ideally, there is a momentary pause as the back swing stops, and the golfer prepares to strike the ball. The downswing is started with a slight lateral movement of the golfer's hips and lower body; the arms, hands, and club should automatically fall into the correct swing plane through the ball and down the desired target line. The lateral movement will also cause the medial edge of the golfer's rear foot to engage the ground, this contact point is the "trigger" used to initiate release of all the stored energy in the swing. The golfer will feel the medial edge of the heel post grip the ground and also feel the power in the swing release sequentially from the rear foot, to the hips, through the back and shoulders and into the arms and hands. The golfer will feel the medial edge of the heel post engage the ground until the point of impact with the ball. After impact, the rear foot will naturally roll over or pronate over the medial edge and the golfer's full weight, as well as the acceleration force, will be transferred to the front foot. It is a common fault for golfers to allow the front foot to roll or to supinate, this leads to a loss of stability and effects accuracy of the shot. The extended lateral edge of the heel post reduces the rolling tendency of the front foot.

In one embodiment of the golf orthotic, the heel post of both orthotics have extended lateral edges, making the orthotics ambidextrous or equally effective for both right and left-handed golfers. In another embodiment, the heal post of the rear foot will have an extended lateral edge and the heel post for the forward foot will have lateral and medial edges that are substantially equal. This embodiment requires separate and unique orthotics for left and right handed golfers.

DETAILED DESCRIPTION OF THE INVENTION

Figure 1:
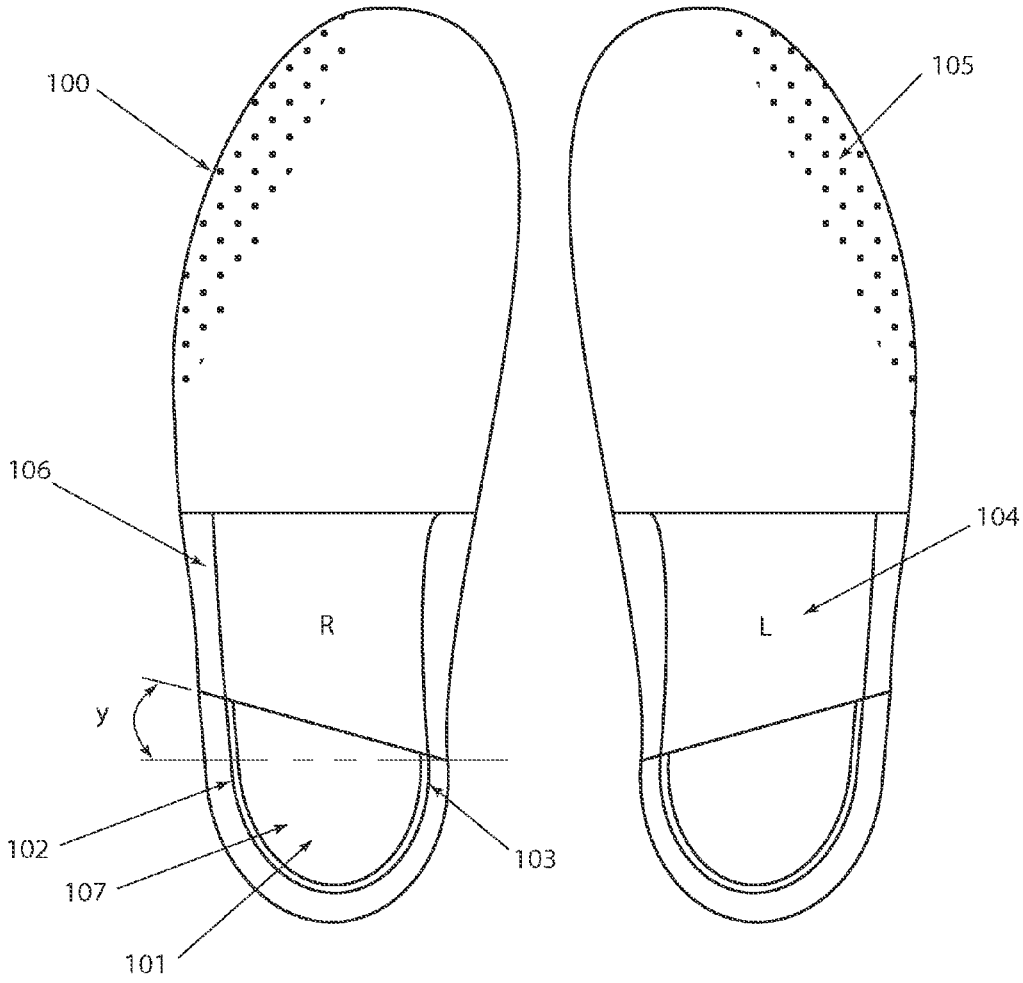
FIG. 1—Bottom view of golf orthotic.
Figure 2:
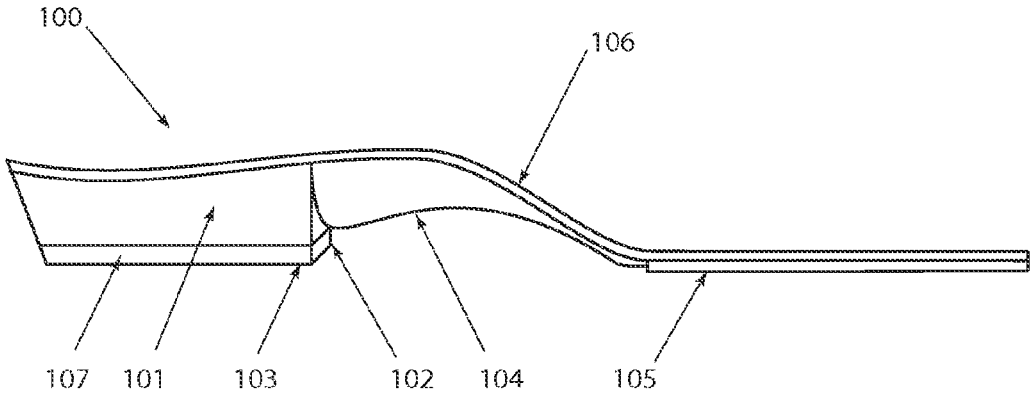
FIG. 2—Side view of golf orthotic.
Figure 3:
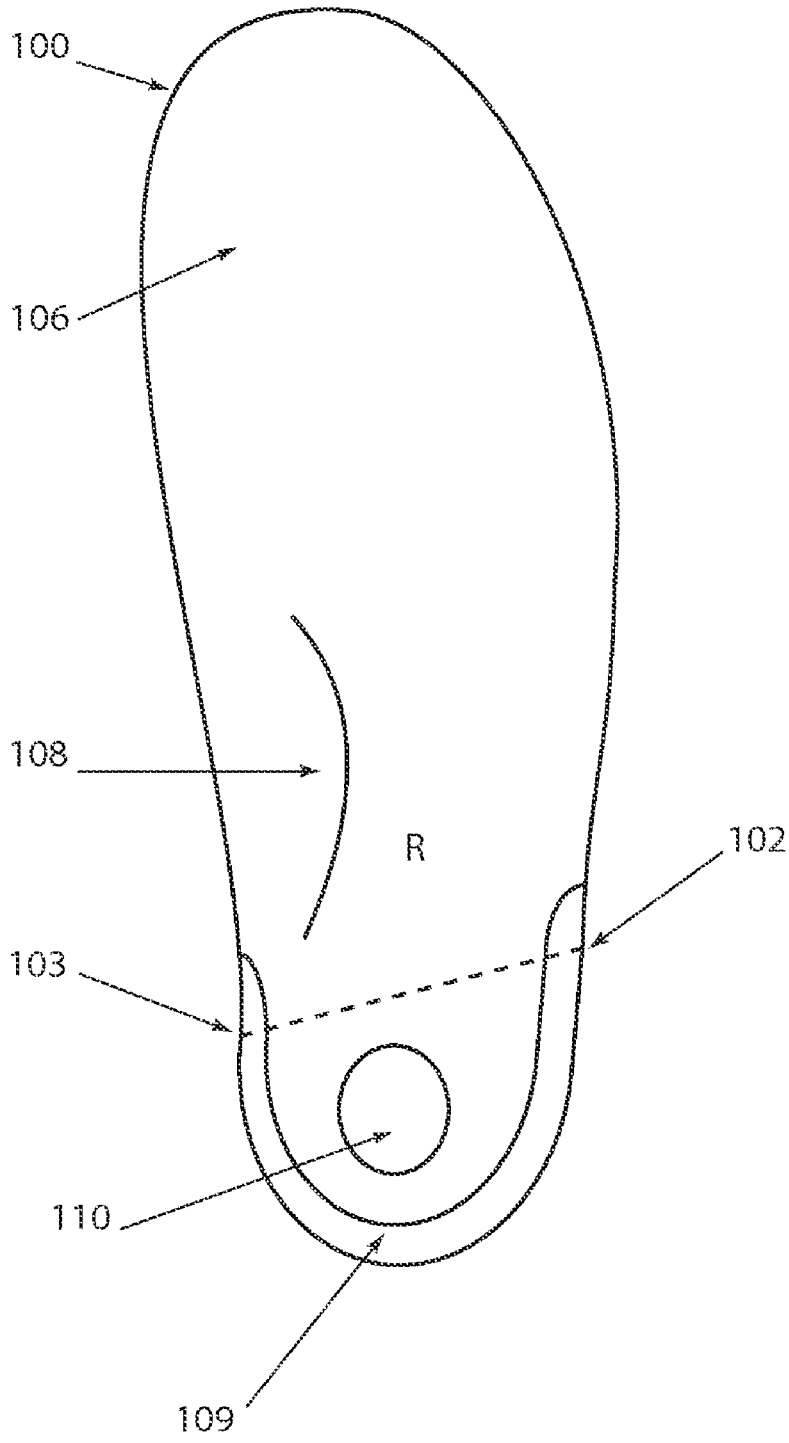
FIG. 3—Top view of golf orthotic.

One embodiment of the golf orthotic 100, is shown and described in FIGS. 1 through 3. Golf orthotic 100 includes; a semi-rigid shell 104, a top cover 106, and anti-skid forefoot pad 105, and heel post 101.

Semi-rigid shell 104 is the foundation for the golf orthotic 100, and includes a deep heel cup 109 and arch support 108; the forefoot portion of shell 104 extends to approximately the metatarsal-phalangeal joint of the foot.

Top cover 106 is adhesively attached to shell 104 and provides user comfort and friction protection. In one embodiment, top cover 106 extends the entire length of the foot as shown. In another embodiment, top cover 106 terminates at the leading edge of semi-rigid shell 104. Heel cushion 110 is disposed under top cover 106 and is positioned to receive the wearer's calcaneus.

One embodiment includes an anti-skid forefoot pad 105. The forefoot pad 105 provides a cushioning effect under the metatarsal heads and includes a friction feature to help secure golf orthotic 100 in the proper position. The friction feature may be dimples, bumps, ridges, treads or another suitable pattern.

Heel post 101 is an essential feature of each embodiment of golf orthotic 100. Heel post 101 is adhesively attached to semi-rigid shell 104 and is positioned with base 107 substantially flat or perpendicular to an axis extending through the ankle and foot of the wearer. The lateral edge 102 of the heel post 101 is substantially longer than the medial edge 103. In one embodiment, the angle y, measured from a baseline, perpendicular to the long axis of the foot and intersecting the end of medial edge 103, is 5 degrees. In one embodiment, angle y is equal to 10 degrees. In another embodiment, angle y is equal to 15 degrees. In another embodiment, angle y is equal to 20 degrees. In another embodiment, angle y is equal to 25 degrees. In another embodiment, angle y is equal to 30 degrees. In another embodiment, angle y is equal to 35 degrees. In another embodiment, angle y is equal to 40 degrees. In another embodiment, angle y is equal to 45 degrees. In yet another embodiment, angle y, measured from a baseline, perpendicular to the long axis of the foot and intersecting the end of medial edge 103, is between 5 and 45 degrees.

Figures 4A, 4B, 4C, 4D:
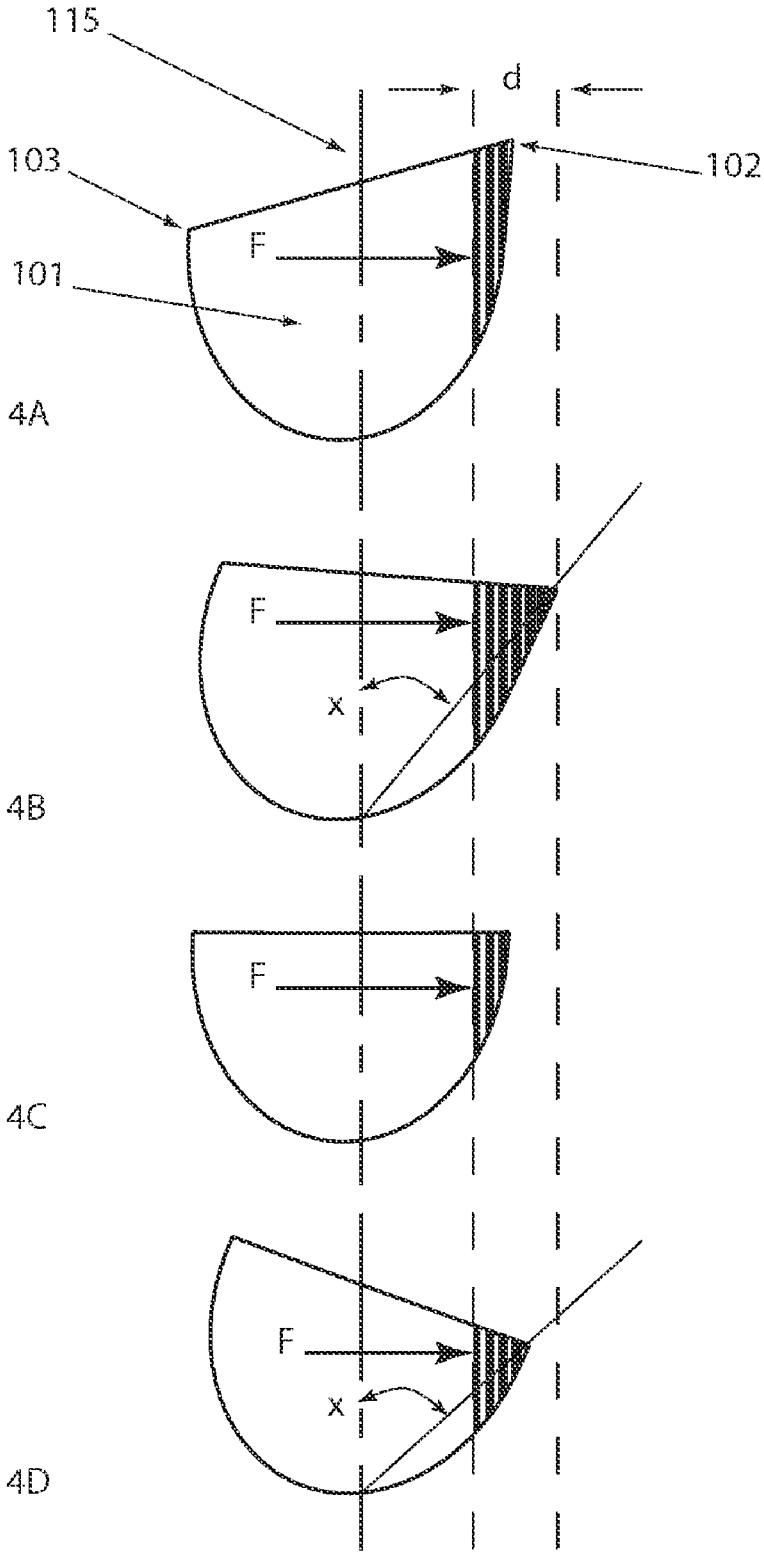
FIG. 4A—Active area of engagement for heel post with extended lateral edge.
FIG. 4B—Active area of engagement for heel post with extended lateral edge in an open position.
FIG. 4C—Active area of engagement for heel post.
FIG. 4D—Active area of engagement for heel post in an open position.

FIG. 4A through 4D describe the effect of the golfer opening, or rotating backward, the rear foot when wearing a heel post 101 with an extended lateral edge 102. FIG. 4A show a heel post 101 with short medial edge 103 and an extended lateral edge 102. The heel post 101 is shown in a neutral position with centerline 115 extending through the apex of heel post 101. Arrow F shows the lateral force created during the golfer's backswing, distance d depicts a moment line where heal post 101 will resist rolling or supination. The shaded portion is the area of heal post 101 that extends over the moment line and where the majority of lateral force F is overcome.

The shaded area of FIG. 4A is substantial due to the extended lateral edge 102, however, when heel post 101 is opened or rotated backward by angle x, approximately 30 degrees as shown, the shaded area behind the moment line is nearly doubled. The shaded area will increase proportionately with each degree the rear foot is opened. It should be noted, that opening the rear foot beyond 45 degrees creates restriction in the golfer's rear knee and limits the golfer's ability to transfer weight forward on the follow through.

FIGS. 4C and 4D show a normal heel post 101, without an extended lateral edge 102, in both neutral and opened positions. In both positions, the shaded area that will resist rolling is approximately equal.

The invention claimed is:

1. A foot orthotic for golf comprising:

a semi-rigid shell;

and a heel post, having a medial edge, a lateral edge and a front edge, the lateral edge is longer than the medial edge.

2. The foot orthotic of claim 1 wherein, the semi-rigid shell includes a deep heel cup.

3. The foot orthotic of claim 1 including, a slip-resistant forefoot pad.

4. The foot orthotic of claim 1 wherein, the front edge of the heel post forms an angle with the longitudinal axis of the semi-rigid shell.

5. The foot orthotic of claim 4 wherein, the angle is equal to 5 degrees.

6. The foot orthotic of claim 4 wherein, the angle is equal to 10 degrees.

7. The foot orthotic of claim 4 wherein, the angle is equal to 15 degrees.

8. The foot orthotic of claim 4 wherein, the angle is equal to 20 degrees.

9. The foot orthotic of claim 4 wherein, the angle is equal to 25 degrees.

10. The foot orthotic of claim 4 wherein, the angle is equal to 30 degrees.

11. The foot orthotic of claim 4 wherein, the angle is equal to 35 degrees.

12. The foot orthotic of claim 4 wherein, the angle is equal to 40 degrees.

13. The foot orthotic of claim 4 wherein, the angle is equal to 45 degrees.

14. The foot orthotic of claim 4 wherein, the angle is greater than 45 degrees.

15. The foot orthotic of claim 4 wherein, the angle is less than 5 degrees.

16. The foot orthotic of claim 4 wherein, the angle is between 1 degree and 45 degrees.

17. A method of using a foot orthotic for golf comprising:
installing a golf orthotic into the golfer's rear foot golf shoe;
the golf orthotic having a heel post with a medial edge and a lateral edge;
the lateral edge is longer than the medial edge;
wearing the rear foot golf shoe;
opening the rear foot before starting a backswing;
initiating a backswing and;
the lateral edge of the heel post resists supination of the golfer's rear foot during the backswing.

18. A method of using a pair of foot orthotics for golf comprising:
installing a pair of golf orthotics into a pair of golf shoes;
the golf orthotics having heel posts with a medial edge and a lateral edge;
the lateral edge of the heel posts is longer than the medial edge;
wearing the golf shoes;
opening the golfer's rear foot before starting a backswing;
initiating a backswing;
the lateral edge of the heel post of the golf orthotic under the golfer's rear foot resists supination of the golfer's rear foot during the backswing;
initiating a forward swing and;
the lateral edge of the heel post of the golf orthotic under the golfer's front foot resists supination of the golfer's front foot during the forward swing;

* * * * *